US005325157A

United States Patent [19]

Takano

[11] Patent Number: 5,325,157

[45] Date of Patent: Jun. 28, 1994

[54] RESET DATA CREATION MECHANISM FOR PHOTOCONDUCTIVE DRUM COUNTER

[75] Inventor: Masatoshi Takano, Tokyo, Japan

[73] Assignee: Asahi Kogaku Kogyo Kabushiki Kaisha, Tokyo, Japan

[21] Appl. No.: 909,018

[22] Filed: Jul. 6, 1992

[30] Foreign Application Priority Data

Jul. 5, 1991 [JP] Japan ..... 3-081953[U]

[51] Int. Cl.[5] ..... G03G 15/00

[52] U.S. Cl. ..... 355/210; 355/208

[58] Field of Search ..... 355/210, 211, 203, 208

[56] References Cited

U.S. PATENT DOCUMENTS

| | | | |
|---|---|---|---|
| 4,585,327 | 4/1986 | Suzuki | 355/211 |
| 5,001,733 | 3/1991 | Negoro et al. | 355/211 X |
| 5,038,173 | 8/1991 | Kusumoto | 355/211 |
| 5,053,816 | 10/1991 | Takahashi | 355/208 |

FOREIGN PATENT DOCUMENTS 4-29159 1/1992 Japan .

*Primary Examiner*—Grimley, A. T.
*Assistant Examiner*—Nestor R. Ramirez
*Attorney, Agent, or Firm*—Sandler, Greenblum & Bernstein

[57] ABSTRACT

A detection mechanism for detecting an installation of a detachable member to a main body, includes a movable member provided on the detachable member and being movable between a first position and a second position. The movable member is set in the first position prior to a first installation of the detachable member to the main body. A detecting switch, provided on the main body, detects the movable member in the first position but is incapable of detecting the movable member in the second position. An actuating member, provided on the main body causes the movable member to move from the first position to the second position when the detachable member has been installed into the main body. A locking mechanism locks the movable member to the second position after the actuating member actuates the movable member to the second position. The detecting switch detects only a first installation of the detachable member.

16 Claims, 5 Drawing Sheets

RESET DATA CREATION MECHANISM FOR PHOTOCONDUCTIVE DRUM COUNTER

BACKGROUND OF THE INVENTION

The present invention relates to a reset data creation mechanism for a photoconductive drum of an imaging apparatus for forming an image on a recording paper by using an electrophotographic method, by which reset data, obtained when the photoconductive drum is replaced, is supplied to a counter for counting data output in synchronism with the operation of the photoconductive drum having an outside peripheral surface composed of a photoconductive material.

An imaging apparatus (so-called printer) provides a hard copy by printing or drawing data output from a computer, word processor, facsimile and the like on a recording paper by making use of an electrophotographic method.

In the electrophotographic process, the photoconductive material on the surface of a photoconductive drum is uniformly charged and then exposed to form a latent image from which electric charges are removed. The latent image is converted to a toner image by being adhered with toner. The toner image is transferred onto a recording paper and further fixed to the recording paper by a fixing unit.

In the imaging apparatus employing the electrophotographic process, occurrences of phenomena such as insufficient charging, the occurrence of after images remaining on the surface of the photoconductive drum, and the like, increase with the wear of a photoconductive material on the surface of the photoconductive drum and the degradation of the electrostatic characteristics of the photoconductive material caused by the repeated use of the photoconductive material which result from respective electrophotographic processes such as a transfer of images, cleaning of the surface of the photoconductive drum and the like, and thus an insufficient printing (insufficient transfer of image onto a recording paper) and the like are caused by these phenomena.

To cope with this problem, the photoconductive drum is arranged as an easily replaceable unit (photoconductive drum unit) and the number of operations of the photoconductive drum is recorded. When the number of operations exceeds a preset number, an operator is prompted to replace the photoconductive drum.

More specifically, a counter is provided to count pulse signals output in synchronism with the rotation of the photoconductive drum and a timing at which the photoconductive drum is to be replaced is determined based on a count value of the counter. Thus when the count value of the counter reaches a preset value (that is, when the preset number of images has been formed), the photoconductive drum is replaced. The counter must be cleared (reset) when a photoconductive drum in use is replaced with a new one, and for this purpose, for example, a switch means such as a microswitch or the like is provided with the main body of the apparatus to sense the presence of a photoconductive drum and the counter is reset in response to a charge of a sensed signal (sensing-not sensing-sensing) output from the switch means when the photoconductive drum is replaced. Note that when the switch means is arranged to sense a switching member which is swung by the installation of a photoconductive drum unit, the counter can be arranged to be reset by a change of signal of not sensing-sensing-not sensing. Further, the switch means may be arranged such that either the presence or absence of a signal output therefrom corresponds to sensing or not sensing.

With the above conventional arrangement, however, a problem arises in that when a photoconductive drum unit is removed once for the maintenance of the apparatus rather than the replacement thereof, and then mounted again, the counter is reset regardless of that the photoconductive drum has not been replaced, and thus the count is disturbed. Therefore, there is a need for an arrangement wherein a counting is not reset when the photoconductive drum unit is removed for such a purpose (e.g., maintenance) and the replaced.

SUMMARY OF THE INVENTION

It is therefore an object of the present invention to provide a reset data creation mechanism for a photoconductor drum counter by which the counter for counting data output in synchronism with the operation of the photoconductive drum is securely reset only when the photoconductive drum is replaced, so that the counter is not reset when the photoconductive drum once removed is mounted again.

To achieve the above object, one aspect of a reset data creation mechanism for a photoconductor drum counter, used in an imaging apparatus for creating reset data in response to which the counter is reset, wherein said imaging apparatus is provided with a main body, and a photoconductive drum unit which includes the photoconductive drum and a holding member for holding said drum and which is detachably mounted to the main body, and said counter counts data output in synchronism with the operation of the photoconductive drum. The reset data creation mechanism includes switch means provided in the main body, for outputting a signal. A counter is reset in response to a change of the level of the signal. A switching member, is movably provided on the holding member, for changing the level of said signal output from said switch means when said drum unit is mounted to a predetermined position in the main body. Actuating means for actuating the switching member to be out of a region where the level of the signal output from the switching means is changed, after the level of the signal output from said switch means has been changed is further provided. Return regulation means are provided for holding the switching member out of the region, after the actuating means has once actuated.

With this arrangement, when a new photoconductive drum unit is mounted to the predetermined position of the main body of the imaging apparatus, the switching member causes the switch means to change a signal output therefrom and the photoconductive drum counter is reset in response to this change of the signal as reset data of the switch means. Thereafter, the switching means is retracted from the sensing region by the retracting operation means and held in this retracted region by the return regulation means. Thus, even if this photoconductive drum unit is removed once and then mounted again, the switching member does not cause the switch means to change a signal output therefrom again so that the photoconductor drum counter is not reset.

As a result, the counter for counting data output in synchronism with the operation of the photoconductive drum is securely reset only when a photoconductive drum in use is replaced with a new one. Thus, a count is not disturbed, even when the photoconductive drum removed for maintenance is mounted again.

To achieve the above object, the other aspect of a detection mechanism, for detecting an installation of a detachable member to a main body, includes a movable member provided on said detachable member and being movable between a first position and a second position. The movable member sets in a first position prior to a first installing operation of said detachable member to the main body. Detecting means are, provided on said main body, for detecting the movable member in the first position, but not capable of detecting the movable member in a second position. Actuating means, provided on the main body, move the movable member from the first position to the second position, when the detachable member has been installed into the main body. Lock means lock the movable member to the second position after the actuating means actuates the movable member into the second position. Thus, the detecting means detects only the first installation of the detachable member.

DETAILED DESCRIPTION OF PREFERRED EMBODIMENT

An embodiment of the present invention will be described below with reference to the drawings.

Figure 1:
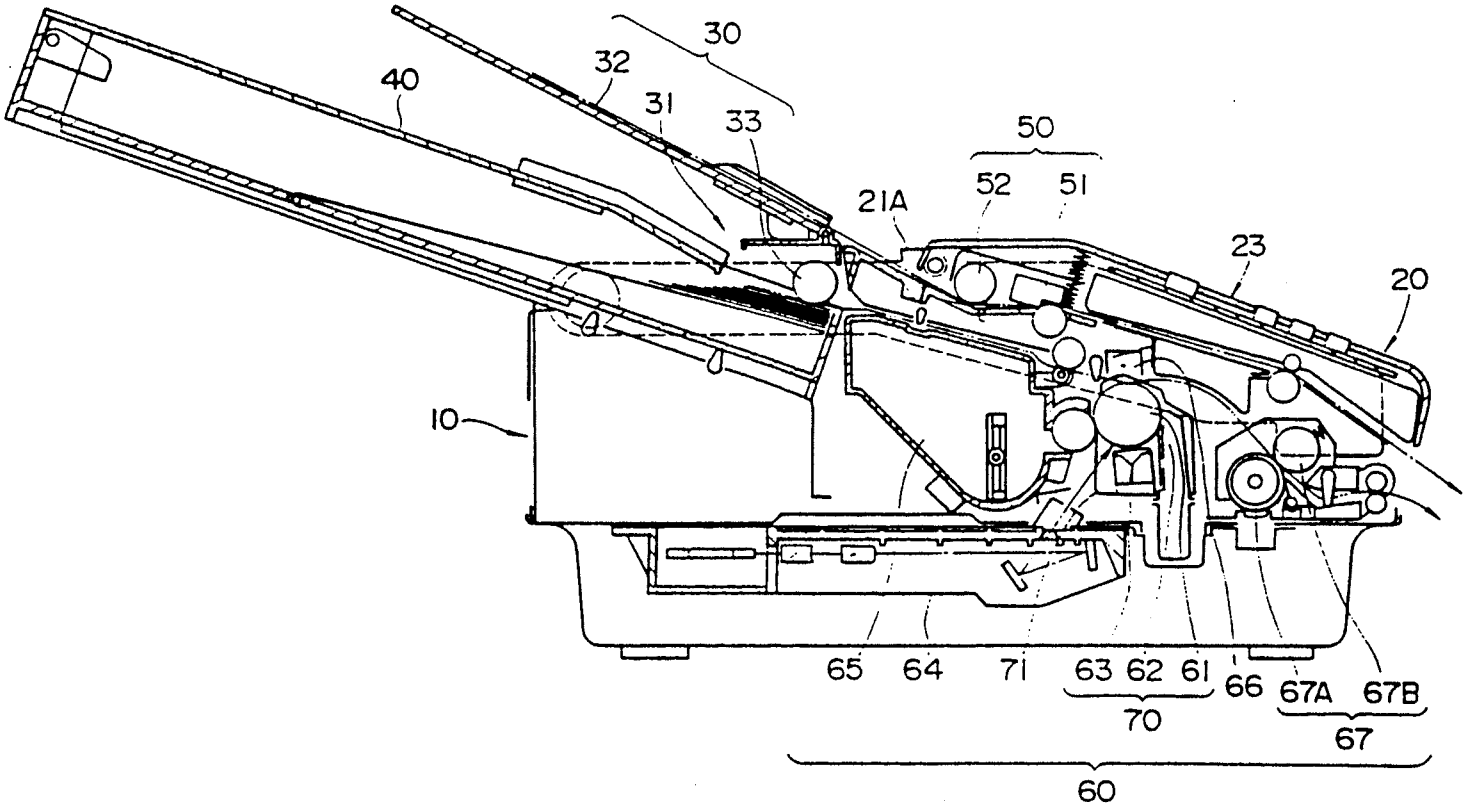
FIG. 1 is a side view schematically showing the arrangement of an electrophotographic facsimile apparatus to which an embodiment of a reset data creation mechanism for a photoconductive drum counter according to the present invention is applied.

FIG. 1 is a schematic arrangement of an electrophotographic facsimile apparatus as an imaging apparatus to which an embodiment of a reset data creation mechanism for a photoconductive drum counter according to the present invention is applied. This figure is a side view and the right side in the figure is the front side of the apparatus.

The illustrated facsimile apparatus includes a paper supply unit 30 at the upper rear end of a main body 10, for supplying into the apparatus a recording paper for receiving information, or a document for transmitting information. The upper front portion of the apparatus, contiguous to the paper supply unit 30, is composed of an upper arrangement member 20, supported by an arm 21A, at the end on the paper supply unit 30 side (rear side) of the main body 10.

The paper supply unit 30 is composed of a cassette mounting portion 31, detachably mounted to a recording paper cassette 40, which accommodates information receiving recording papers as cut sheet papers and a document holder 32 for an information transmitting document mounted in front of the cassette mounting portion 31 (right side in FIG. 1). A recording paper introduction roller 33 is disposed at the position corresponding to the upper front end of the recording papers accommodated in the recording paper cassette 40 mounted to the cassette mounting portion 31.

The upper arrangement member 20 has an upper surface formed as an inclined surface gradually declining toward the front end of the apparatus and a portion of the declined surface is arranged as an operation unit 23 including a display panel, operation buttons and the like disposed thereon.

A document reading mechanism is disposed in the upper arrangement member 20. The document reading mechanism is composed of a reading head 50 including a reading sensor 51 and a document introduction roller 52 disposed on the document holder 32 side in the vicinity of the reading sensor 51, and a document feed path formed in confrontation with the reading head 50.

A reading head 50 is disposed in the upper arrangement member 20 and includes a reading sensor 51, a document introduction roller 52 disposed adjacent to the document reading sensor 51 on the document holder 32 side, and a document feed path formed in confrontation with the reading head 50. A transmitting document placed on the document holder 32 of the paper supply unit 30 is introduced into the upper arrangement member 20 by the document introduction roller 52, and fed along the path shown by the dot-dash-line in FIG. 1. Information written on the document is read by the reading sensor 51, and then the document is discharged through a transmitting document discharge port defined in the front surface of the front end of the main body 10.

The recording unit 60 includes a cleaning mechanism for cleaning toner remaining on the surface of a photoconductive drum 61, by abutting a blade formed of an elastic member against the surface thereof, a corona charger for uniformly charging the photoconductive material on the surface of the photoconductive drum 61, a scanning optical unit 64 for exposing and scanning the surface of the photoconductive drum 61 with a laser beam turned ON and OFF in response to image data, a development unit 65 for adhering toner to a portion of the photoconductive material from which electric charges are removed by exposure and converted to a latent image and making the latent image into a toner image, a transfer charger 66 for charging a recording paper and transferring the toner image thereon, each unit disposed about the photoconductive drum 61 driven in rotation at a predetermined circumferential speed by a drive motor (not shown). Further, a fixing unit 67, which includes a heat roller 67A, heated to a predetermined temperature, and a press roller 67B, disposed obliquely upwardly, of the heat roller 67A on the front end side of the apparatus and pressed against the heat roller 67A, is disposed at a location to which the recording paper on which the toner image is transferred by the transfer charger 66 is fed.

The recording papers accommodated in the recording paper cassette 40 are sequentially introduced into a recording paper path from the uppermost one thereof by the rotation of the recording paper introduction roller 33, while the surface of the photoconductive drum 61 is main scanned (exposed) by a laser beam supplied from the scanning optical unit 64 and modulated in response to received print or image data. At the same time, the photoconductive drum 61 is rotated (sub-scanned) so that the electrostatic latent image is formed on the surface of the photoconductive drum 61. This latent image is developed into the toner image by the development unit 65A. The toner image is transferred to the recording paper fed along a path shown in FIG. 1 by the two-dot-and-dash line and charged by the transfer charger 66. Further, the toner image is fixed to the recording paper by the fixing unit 67, and then the recording paper is discharged through the front end of the apparatus.

The photoconductive drum 61, cleaning mechanism 62 and corona charger 63 of the above recording unit 60, are integrally mounted to a single unit frame 71 as a holding member, and arranged as a drum unit 70. Thus when the photoconductive drum 61 is to be replaced because the photoconductive material on the surface of the photoconductive drum 61 is worn, or the electrostatic characteristics of the photoconductive material is degraded, this drum unit 70 is replaced as a whole.

As shown in the perspective view of FIG. 2, the cross sectional view of a swing member 80 to be described later taken along the vertical line passing through the center of the support shaft 81 of FIG. 3, and FIG. 5 as a cross sectional view taken along the line A—A of the FIG. 3, the reset mechanism for the counter is disposed at an end in the longitudinal direction of the drum unit 70.

The reset mechanism for the counter is arranged such that a swing member 80, as a switch member, is rotatably supported by front and rear walls 72, 73 through a support shaft 81 and accommodated in an accommodation space 74. The accommodation space is formed at the lower corner of a side end of the unit frame 71, has side end portions surrounded by the front and rear walls 72, 73 and is opened downward. Support shaft 81 passes through a locking fixture 90 for supporting the same, and a photo-interrupter 100, as a switch means, is disposed on the chassis 11 of the facsimile apparatus as the main body of the apparatus in confrontation with the swing member 80. Note that the photoconductive drum is not mounted to the unit frame 71 shown in FIG. 2.

The photo-interrupter 100 includes a light projection unit 101 and light receiving unit 102 disposed in confrontation at a predetermined distance provided therebetween as a sensing region, and a signal output from the photo-interrupter 100 is turned ON or OFF depending upon the presence or absence of an interruption member (shutter) in the sensing region. The signal from the photo-interrupter 100, is input to a control unit (not shown) of the apparatus, and when a signal from the photo-interrupter 100 is interrupted (turned OFF), the number counted by the counter provided with the control unit form counting a pulse signal output in synchronism with the rotation of the photoconductive drum (for counting the number of recording papers on which images are formed) is reset.

The swing member 80 is arranged such that a sensor arm 82 is extended perpendicularly from substantially the center in the lengthwise direction of the support shaft 81 perpendicularly thereto and a shutter plate 83 is extended downward at the extreme end of the sensor arm 82.

The support shaft 81 has one end formed into a head portion 81A of larger diameter than the rest of the shaft 81, and other end having a predetermined width cut off by two planes 81B, 81B perpendicular to the sensor arm 82. Further, the support shaft 81 has a mounting portion 81C of smaller diameter formed on the head portion 81A side in the vicinity of the portion where the sensor arm 82 is formed and the mounting portion 81C has a predetermined length in an axial direction. The support shaft 81 has such a length that when the flange surface of the head portion 81A is abutted against a front wall 72, the other end of the support shaft 81 projects from the outside surface of a rear wall 73 by a predetermined amount, and when the mounting portion 81C is located in the slit 72B of the front surface 72, the extreme end of the support shaft 81 is located inwardly of the inside surface of the rear wall 73.

Figure 4:
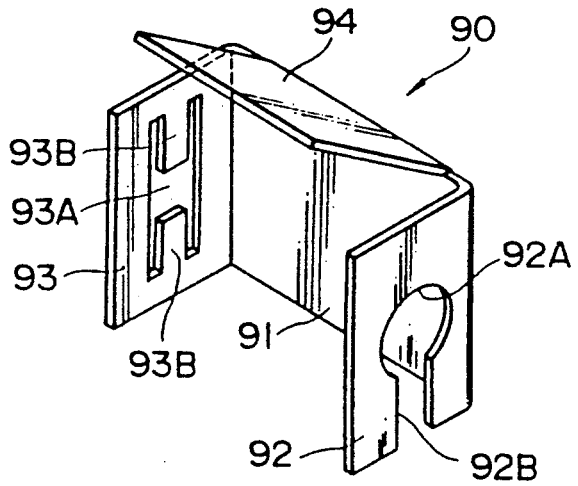
FIG. 4 is a perspective view of a locking fixture.

As shown in the perspective view of FIG. 4, a locking fixture 90 includes a base surface 91 having right and left ends bent to the same side at a right angle to thereby form support side surfaces 92, 93 and the upper end of the base surface 91, is bent to the side similar to that of the support side surfaces 92 and 93 at a predetermined angle to thereby form an engagement portion 94. As described above, the support side surface 92 is abutted against the front wall 72 of the unit frame 71, and the rear wall 93 is confronted with the rear wall 73 of the unit frame 71 by being supported by the swing member 80 and disposed in an accommodation space 74 with the open side thereof directed to the side end of the unit frame 71.

A mounting hole 92A is defined in the support side surface 92 abutted against the front wall 72 to enable the support shaft 81 of the swing member 80 to pass therethrough and opens downwardly; through a slit 92B having a predetermined width which permits the mounting portion 81C of the support shaft 81 to pass therethrough, while prohibiting any portion other than the mounting portion 81C from passing therethrough.

Further, a rectangular H-shaped engaging hole 93A is defined in the support side surface 93 confronted with the rear wall 73. This engaging hole 93 has longer sides in a vertical direction, a width (the width between the surfaces 81B, 81B) enabling the extreme end of the support shaft 81 of the swing member 80 to pass therethrough, and elastically deformable portions 93B, 93B with a predetermined width projecting from the upper and lower sides of the engaging hole 93 toward the center thereof. The support shaft 81 can pass through the engagement hole 93A in such a manner that the two side surfaces 81B, 81B at the extreme end thereof face a width direction and the elastically deformable portions 93B, 93B are elastically deformed by the support shaft 81. Thus, the support shaft 81, passing through the engagement hole 93A, cannot relatively rotate with respect to locking fixture 90 and is engaged in an axial direction by the elastically deformable members 93B, 93B.

Mounting holes 72A, 73A, with which the support shaft 81 are rotatably engaged, are defined in the front and rear walls 72, 73 of the unit frame 71, respectively. Mounting hole 72A of the front wall 72 is opened downward though a slit 72B having a predetermined width which permits the mounting portion 81C of the support shaft 81 to pass therethrough and prohibits any portion other than the mounting portion 81C from passing therethrough.

The locking fixture 90 is disposed in the accommodation space 74, such that the mounting hole 92A of the support side surface 92 thereof corresponds to the mounting hole 72A of the front wall 72 of the unit frame 71. Also, the center of the engagement hole 93A of the support side surface 93 corresponds to the center of the mounting hole 73A of the rear wall 73. Support shaft 81 of the swing member 80 is concentrically positioned with respect to the mounting holes 92A, 72A with the mounting portion 81C of the support shaft 81 passing through the locking fixture 90 and the slits 92B, 72B of the front wall 72. Thereafter, the extreme end of the support shaft 81 is caused to pass through the engagement hole 93A of the locking fixture 90 by elastically deforming the elastically deformable portions 93B, 93B of the locking fixture 90. Further, the extreme end is caused to pass through the support hole 73A of the rear wall 73, and as a result the swing member 80 and the locking fixture 90 are supported in the accommodation space 74, as shown in FIG. 3. More specifically. The locking fixture 90 is engaged with the support shaft 81 in the state that the locking fixture 90 cannot be relatively rotated with respect to the support shaft 81, and moved in the axial direction of the support shaft 81. The movement of the locking fixture 90 is regulated by the front and rear walls 72, 73. The swing member 80 is swingably mounted to the unit frame 71, and at the same time, the locking fixture 90 is supported in the accommodation space 74 by the swing member 80.

Figure 5:
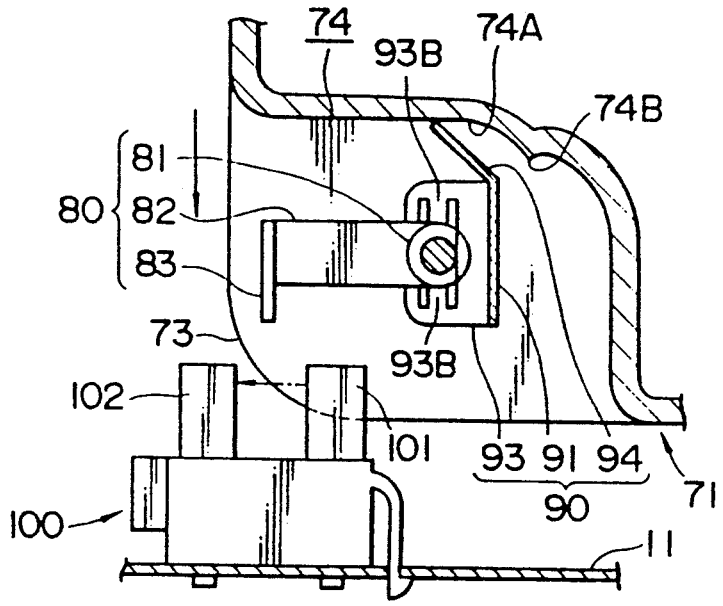
FIG. 5 is a cross sectional view taken along the line A—A of FIG. 3.

On the other hand, an inside wall surface 74A ranging from the upper surface of the accommodation space 74 of the unit frame 71 to the central portion in the lengthwise direction of the unit frame 71 is formed along the rotating locus of the extreme end of the locking fixture 90, formed when the swing member 80 is rotated and an engaging projection 74B having a predetermined height is formed toward the support shaft 81 side at a position to which the extreme end of the engagement portion 94 corresponds when the locking fixture 90 is rotated clockwise in FIG. 5 by a predetermined angle. This engagement projection 74B is arranged such that when the locking fixture 90 is rotated together with the swing member 80, clockwise in FIG. 5, the engagement portion 94 of the locking fixture 90 is elastically deformed so that the engagement portion 94 can get over the engagement projection 74B, and when the engagement portion 74 gets over the engagement projection 74B once, the extreme end of the engagement portion 94 is engaged with the engagement projection 74B, so that the engagement projection 94 cannot be moved backward (i.e., cannot be rotated counterclockwise). When the unit frame 71 is mounted to a predetermined position to be described later) that the extreme end of the engagement portion 94 is engaged with the engagement projection 74B as described above, the shutter plate 83 at the extreme end of the sensor arm 82 cannot be positioned in the sensing region of the photo-interrupter 100. More specifically, a return regulation means used in this embodiment is composed of the engagement portion 94 of the locking fixture 90 and the engagement projection 74B projecting from the inside wall surface 74A of the accommodation space 74.

Figure 2:
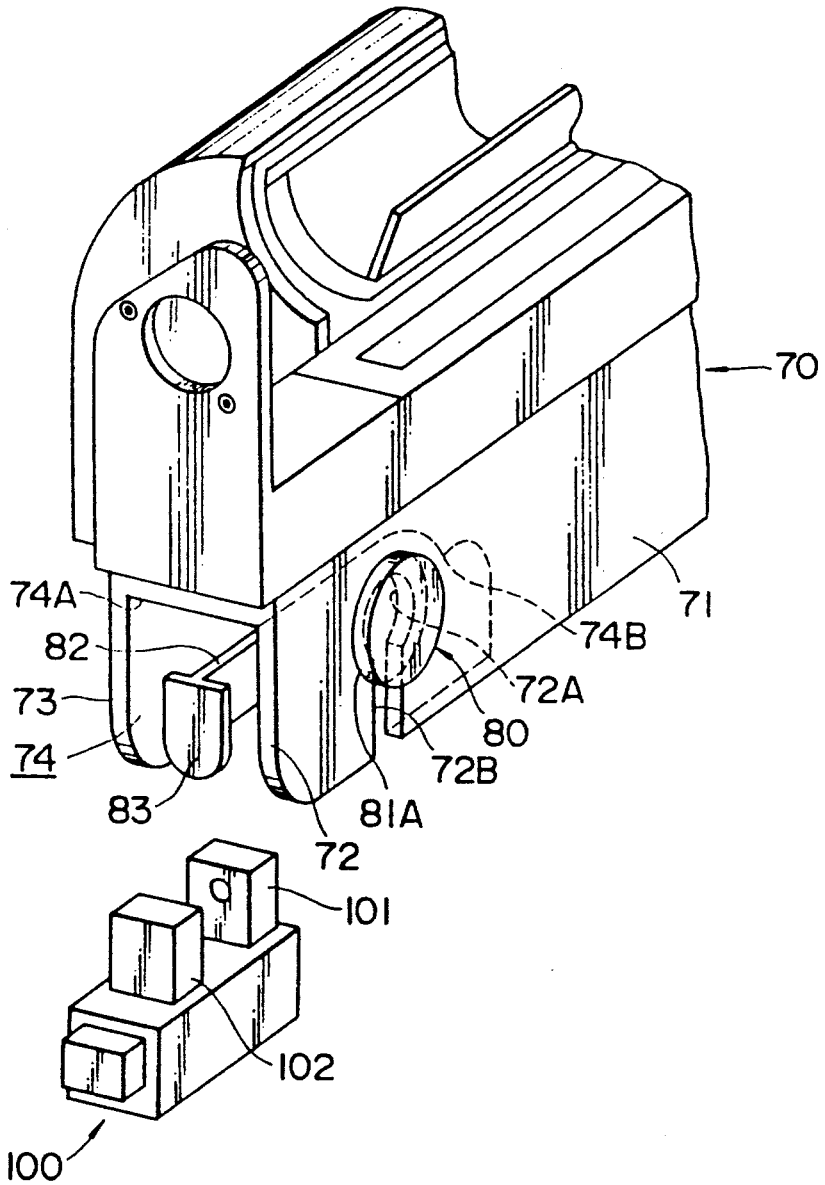
FIG. 2 is an exploded perspective view of the side end of the unit frame of a photoconductive drum serving as a reset mechanism portion.
Figure 3:
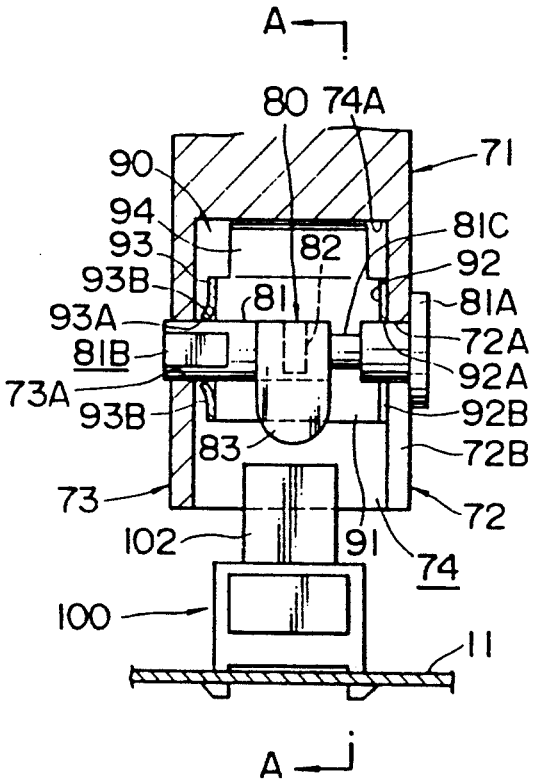
FIG. 3 is a cross sectional view of the reset mechanism portion.
Figure 6:
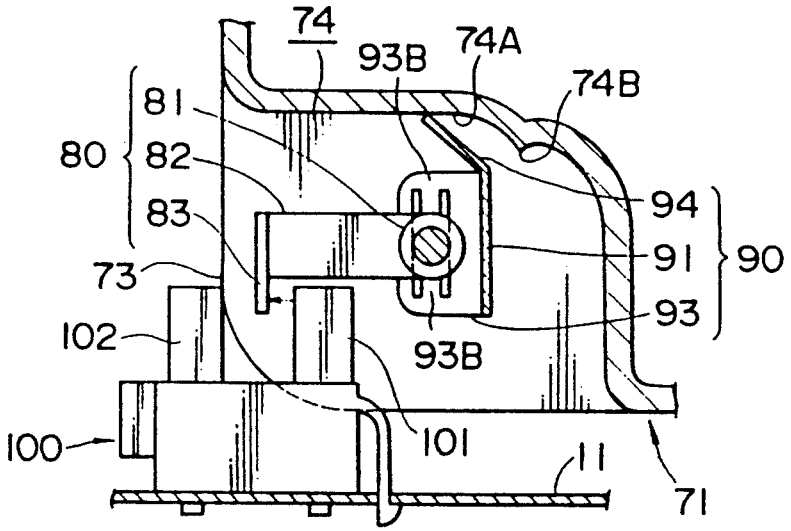
FIG. 6 shows a photoconductive drum unit in a mounting process corresponding to FIG. 5.
Figure 7:
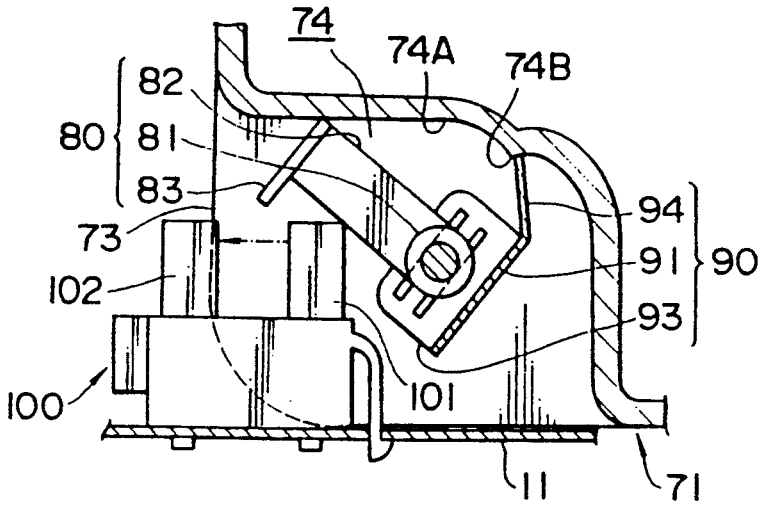
FIG. 7 shows a mounted state of the photoconductive drum unit corresponding to FIG. 5.

The photo-interrupter 100 is disposed in such a positional relationship that when the photoconductive drum (unit frame 71) is not mounted as shown in FIGS. 2, 3 and 5, the photo-interrupter 100 is mounted to the chassis 11 of the apparatus in such a manner that the sensing region of the photo-interrupter 100 is located just below the shutter plate 83 of the sensor arm 82 of the swing member 81. When the unit frame 71 is lowered (moved to the chassis 11 side) to mount the photoconductive drum to a predetermined positioned from the illustrated state, the sensor arm 82 is abutted against the upper surface of the light projection unit 101, as shown in FIG. 6, after the shutter plate 83 has reached the sensing region of the photo-interrupter 100. When the unit frame 71 is further lowered by a predetermined amount from this state, it is mounted to a predetermined position as shown in FIG. 7. With this positional relationship, since the sensor arm 82 of the swing member 80 is regulated to move to the light projection unit 101 from the time at which the sensor arm 82 is abutted against the upper surface of the light projection unit 101 to the time at which the sensor arm 82 is mounted to the predetermined position in the process of mounting the unit frame 71 (photoconductive drum), the swing member 80 is rotated clockwise in the figure together with the locking fixture 90, and the engagement portion 94 of the locking fixture 80 gets over the engagement projection 74B projected from the inside wall surface 74A of the accommodation space 74 and engaged therewith, in such a manner that the engagement projection 94 cannot return to the counterclockwise direction. More specifically, in this embodiment, the light projection unit 101 of the photo-interrupter 100 constitutes a retracting operation means. Note that this operation means may be composed of a separate operation member.

With the aforesaid arrangement, when the photoconductive drum is replaced (i.e. when the drum unit 70 is replaced), the shutter plate 83 of the swing member 80 reaches the sensing region of the photo-interrupter 100 in the process of mounting a new drum unit 70, and a signal from the photo-interrupter 100 is interrupted once. Thereafter, the swing member 80 is rotated by the abutment of the sensor arm 82 against the light projection unit 101, and the engagement portion 94 of the locking fixture 80 gets over the engagement projection 74B projected from the inside wall surface of the accommodation space 74 of the unit frame 71 and engaged therewith, in such a manner that the engagement projection 94 cannot return to the counterclockwise direction, whereby the swing member 80 cannot be swung (cannot be returned) to the counterclockwise direction, so that the shutter plate 83 of the swing member 80 is not positioned in the sensing region of the photo-interrupter 100.

Therefore, even if the unit frame 71, mounted once to the predetermined position, is removed and then mounted again, the shutter plate 83 of the swing member 80 does not reach the sensing region of the photo-interrupter 100 when the unit frame 71 is mounted again. Thus a signal from the photo-interrupter 100 is not interrupted.

More specifically, according to this arrangement, a signal from the photo-interrupter 10 is interrupted once only when the new photoconductive drum (drum unit 70) is mounted. When the same photoconductive drum is mounted again, a signal from the photo-interrupter 100 is not interrupted. As a result, the counter for counting the number of rotation of a photoconductive drum is securely reset only when the photoconductive drum is replaced in such a manner that the counter is reset in response to the interruption of a signal from the photo-interrupter 100.

Note, although the aforesaid embodiment of the present invention is applied to the facsimile apparatus provided with the reading head, it may be of course applied to any imaging apparatus such as a printer and the like.

The present disclosure relates to subject matters contained in Japanese Utility Model Application No. HEI 3-81953 filed on Jul. 5, 1991, which is expressly incorporated herein by reference in its entirety.

What is claimed is:

1. A reset data creation mechanism for a photoconductor drum counter used in an imaging apparatus for creating reset data in response to which the counter is reset, wherein said imaging apparatus is provided with a main body, and a photoconductive drum unit which includes the photoconductive drum and a holding member for holding said drum and which is detachably mounted to the main body, and said counter counts data output in synchronism with the operation of the photoconductive drum, said reset data creation mechanism comprising:

switch means, provided on said main body, for outputting a signal, said counter being reset in response to a change of the level of said signal;

a switching member, movably provided on said holding member, for changing the level of said signal output from said switch means when said drum unit is mounted to a predetermined position in said main body;

actuating means for actuating said switching member to be out of a region where the level of said signal output from said switching means is changed, after the level of said signal output from said switch means has been changed; and return regulation means for holding said switching member out of said region after said actuating means has once actuated;

wherein the counter is reset upon said change of level of said signal output as a direct result of mounting said drum unit.

2. The reset data creation mechanism according to claim 1, wherein said switch means comprises a photo-interrupter having a light projection unit and light receiving unit disposed in confrontation, wherein said signal is changed by an interruption member disposed between said light projection unit and said light receiving unit, and said switching member disposed between said light projection unit and said light receiving unit causes said switch means to change said signal.

3. The reset data creation mechanism according to claim 1, wherein said actuating means is fixedly disposed at a position interfering with a region to which said switching member is moved when said photoconductive drum unit is mounted to the predetermined position of the main body of said imaging apparatus after said switching member has caused said switch means to change said signal, and said switching member is relatively moved in abutment against said actuating means when said photoconductive drum unit is mounted to said predetermined position and retracted from said region where said switch means changes a signal output therefrom.

4. The reset data creation mechanism according to claim 3, wherein said switch means comprises a photo-interrupter having a light projection unit and light receiving unit disposed in confrontation, said signal is changed by an interruption member disposed between said light projection unit and said light receiving unit, said switching member disposed between said light projection unit and said light receiving unit causes said switch means to change a signal output therefrom, and the light projection unit or light receiving unit of said switch means acts as said actuating means.

5. The reset data creation mechanism according to claim 1, wherein said switching member is rotatably supported by the holding member of said photoconductive drum unit, said return regulation means includes a locking member relatively unrotatably provided with said switching member and having an elastically deformable locking arm portion extending outwardly from said locking member and a locking projection projected from the inside wall of a switching member accommodation space formed to said holding member and interfering with the moving region of the locking arm portion of said locking member, and said locking arm portion is elastically deformed by the rotation of said locking member rotated by said switching member, gets over said locking projection, and is engaged with said locking projection, so that said switching member cannot return.

6. the reset data creation mechanism according to claim 5, wherein said switch means comprises a photo-interrupter having a light projection unit and light receiving unit disposed in confrontation, said signal is changed by an interruption member disposed between said light projection unit and said light receiving unit, said switching member disposed between said light projection unit and said light receiving unit causes said switch means to change a signal output therefrom, the light projection unit or light receiving unit of said switch means acts as said actuating means, and said switching member is abutted against the light projection means or light receiving means of said photo-interrupter and retracted from said region where said switch means change a signal output therefrom, from the time at which said switch means changes said signal output therefrom to the time at which said photoconductive drum unit is mounted to the predetermined position of the main body of said imaging apparatus after said switching member has caused said switch means to change said signal output therefrom.

7. The reset data creation mechanism according to claim 1, wherein said switching member is resettable to said region where the level of said signal output from said switching means is changed.

8. The reset data creation mechanism according to claim 1, wherein said holding member is reusable to mount a new photoconductive drum and said switching member is resettable to said region where the level of said signal output from said switching means is changed, so that, upon mounting said holding member containing a new photoconductive drum to said main body, said switch means detects said switching member and outputs a signal to reset said counter.

9. A detection mechanism for detecting an installation of a detachable member to a main body, which comprises:

a movable member provided on said detachable member and being movable back and forth between a first position and a second position, said movable member being set in said first position prior to a first installing operation of said detachable member on the main body;

detecting means, provided on the main body, for detecting said movable member in said first position but being incapable of detecting said movable member in said second position;

actuating means, provided on the main body, for causing said movable member to move from said first position to said second position upon installation of said detachable member into the main body; and lock means for locking said movable member to said second position after said actuating means actuates said movable member to said second position, whereby said detecting means detects only a first installation of said detachable member and establishes a signal as a direct result of the detection of said first installation.

10. The detection mechanism according to claim 9, wherein said movable member is rotatably attached to said detachable member.

11. The detection mechanism according to claim 9, wherein said detecting means includes a photo-interrupter which is fixed on said main body in such a position that a photo-receiving operation is interrupted only by the movable member in said first position.

12. The detection mechanism according to claim 11, wherein said photo-interrupter includes a light projection unit and a light receiving unit disposed in confrontation, and said actuating means is constructed by one of said light projection unit and said light receiving unit.

13. The detection mechanism according to claim 9, wherein said lock means comprises a locking member relatively unrotatably provided with said movable member and having an elastically deformable locking arm portion extending outwardly from said locking member and a locking projection projected from the inside wall of a movable member accommodation space formed to said detachable member and interfering with the moving region of the locking arm portion of said locking member, and said locking arm portion being elastically deformed by the rotation of said locking member rotated by said movable member, gets over said locking projection, and is engaged with said locking projection, so that said switching member cannot return.

14. The detection mechanism of claim 9, wherein said signal established as a direct result of the detection of said first installation, signals a reset of a counter.

15. A reset data creation mechanism for a photoconductor drum counter used in an imaging apparatus for creating reset data in response to which the counter is reset, wherein said imaging apparatus is provided with a main body, and a photoconductive drum unit which includes the photoconductive drum and a holding member for holding said drum and which is detachably mounted to the main body, and said counter counts data output in synchronism with the operation of the photoconductive drum, said reset data creation mechanism comprising:

switch means, provided on said main body, for outputting a signal, said counter being reset in response to a change of the level of said signal;

a resettable switching member, movably provided on said holding member, for changing the level of said signal output from said switch means when said drum unit is initially mounted to a predetermined position ins aid main body;

actuating means for actuating said switching member to be out of a region where the level of said signal output from said switching means is changed for mountings of said drum unit subsequent to said initial mounting; and means for holding said switching member out of said region after said actuating means has once actuated;

wherein said switch means outputs a change of the level of said signal in direct response to said initial mounting of said drum unit.

16. The reset data creation mechanism of claim 15, wherein said resettable switching member is resettable to a region where the level of said signal output from said switching means is changed, upon installation of a new photoconductive drum in said photoconductive drum unit.

* * * * *

UNITED STATES PATENT AND TRADEMARK OFFICE

CERTIFICATE OF CORRECTION

PATENT NO. : 5,325,157

DATED : June 28, 1994

INVENTOR(S) : Masatoshi TAKANO

It is certified that error appears in the above-indentified patent and that said Letters Patent is hereby corrected as shown below:

At column 10, line 25 (claim 6, line 1), change "the" to ---The---.

At column 12, line 28 (claim 15, line 20), change "ins aid" to ---in said---.

Signed and Sealed this

Eighth Day of October, 1996

Bruce Lehman

*Attest:*

BRUCE LEHMAN

*Attesting Officer*

*Commissioner of Patents and Trademarks*